US012312902B2

(12) United States Patent
Roselier

(10) Patent No.: US 12,312,902 B2
(45) Date of Patent: May 27, 2025

(54) SYSTEM AND METHODOLOGY FOR PROVIDING BYPASS THROUGH AN EXPANDABLE METAL PACKER

(71) Applicant: Schlumberger Technology Corporation, Sugar Land, TX (US)

(72) Inventor: Samuel Roselier, Bruz (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/576,248

(22) PCT Filed: Jun. 30, 2022

(86) PCT No.: PCT/US2022/035643
§ 371 (c)(1),
(2) Date: Jan. 3, 2024

(87) PCT Pub. No.: WO2023/283094
PCT Pub. Date: Jan. 12, 2023

(65) Prior Publication Data

US 2024/0328279 A1 Oct. 3, 2024

(30) Foreign Application Priority Data

Jul. 7, 2021 (EP) ..... 21305934

(51) Int. Cl.
*E21B 33/127* (2006.01)

(52) U.S. Cl.
CPC ..... *E21B 33/127* (2013.01); *E21B 33/1277* (2013.01)

(58) Field of Classification Search
CPC ..... E21B 33/127; E21B 33/1277
See application file for complete search history.

(56) References Cited

U.S. PATENT DOCUMENTS

2006/0042801 A1* 3/2006 Hackworth ..... E21B 43/103 166/387
2007/0012437 A1 1/2007 Clingman
(Continued)

FOREIGN PATENT DOCUMENTS

WO 2013079575 A1 6/2013
WO 2015169959 A2 11/2015
(Continued)

OTHER PUBLICATIONS

Hydraulic Dry Mate Connector, downloaded on Dec. 27, 2023 from the link: https://www.slb.com/completions/well-completions/subsurface-safety-valves/accessories/hydraulic-dry-mate-connector (1 page).
(Continued)

*Primary Examiner* — Giovanna Wright
(74) *Attorney, Agent, or Firm* — Jeffrey D. Frantz

(57) ABSTRACT

A technique facilitates improved actuation and use of packers which may be disposed along a well string placed in a borehole, e.g. a wellbore. Each packer may be constructed with or mounted about a tubing and may further comprise a mandrel disposed about or integrally formed with the tubing. The packer may further comprise a sealing element mounted about an expandable metal bladder which, in turn, is secured around the mandrel via suitable connections, e.g. end connections. The mandrel is constructed with a feedthrough or a plurality of feedthroughs which enable placement of alternate path tubes, hydraulic lines, electric lines, or other components through the packer.

7 Claims, 7 Drawing Sheets

(56) References Cited

U.S. PATENT DOCUMENTS

| | | | | |
|---|---|---|---|---|
| 2017/0145777 | A1* | 5/2017 | Vasques | E21B 41/0035 |
| 2018/0010414 | A1* | 1/2018 | Hazel | E21B 43/08 |
| 2020/0072018 | A1 | 3/2020 | Roselier | |

FOREIGN PATENT DOCUMENTS

| | | | |
|---|---|---|---|
| WO | 2016065235 | A1 | 4/2016 |
| WO | 2017089343 | A1 | 6/2017 |
| WO | 2018007483 | A1 | 1/2018 |
| WO | 2018060416 | A1 | 4/2018 |

OTHER PUBLICATIONS

International Search Report and Written Opinion issued in PCT Application PCT/US2022/035643, dated Sep. 19, 2022 (12 pages).

* cited by examiner

SYSTEM AND METHODOLOGY FOR PROVIDING BYPASS THROUGH AN EXPANDABLE METAL PACKER

CROSS-REFERENCE TO RELATED APPLICATIONS

This application is a national stage entry under 35 U.S.C. 371 of International Application No. PCT/US2022/035643 entitled "System and Methodology for Providing Bypass through an Expandable Metal Packer," filed Jun. 30, 2022, which claims the benefit of European Patent Application No. 21305934.8 entitled "System and Methodology for Providing Bypass through an Expandable Metal Packer," filed Jul. 7, 2021, the disclosure of which is incorporated by reference in its entirety.

BACKGROUND

In many oil and gas well applications, a wellbore is drilled into the earth and through a reservoir of a desired fluid, e.g. oil and/or gas. The wellbore may subsequently be completed with appropriate completion equipment having packers which may be expanded to isolate regions along the wellbore. For example, packers may be disposed along sand control equipment or other types of completion equipment to facilitate production of the desired fluids from the reservoir. Depending on the application, the packers may be mounted along production tubing and selectively expanded to effectively form a seal between the production tubing and the surrounding wellbore wall. In some applications, the completion equipment may comprise alternate path systems, control lines, and/or other components which extend down along the production tubing. However, routing such components through existing packer designs while maintaining desired packer functionality can be expensive and/or problematic.

SUMMARY

In general, a system and methodology facilitate improved actuation and use of packers disposed along a well string and placed in a borehole, e.g. a wellbore. Each packer may be constructed with or mounted about a tubing and may further comprise a mandrel disposed about or integrally formed with the tubing. The packer may further comprise a sealing element mounted about an expandable metal bladder which, in turn, is secured around the mandrel via suitable connections, e.g. end connections. The mandrel is constructed with a feedthrough or a plurality of feedthroughs which enable placement of alternate path tubes, hydraulic lines, electric lines, or other components through the packer.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate improved actuation and use of packers disposed in a wellbore or other type of borehole. According to an embodiment, the packer may be constructed with or mounted about a tubing and may further comprise a mandrel disposed about or integrally formed with the tubing. The packer also comprises a sealing element mounted about an expandable metal bladder which, in turn, is secured around the mandrel via suitable connections, e.g. end connections. The mandrel is constructed with a feedthrough or a plurality of feedthroughs which enable placement of alternate path tubes, hydraulic lines, electric lines, or other components through the packer.

An individual packer or a plurality of packers may be disposed along a well string to enable isolation of zones/ regions along the wellbore or other type of borehole. For example, a plurality of the packers may be disposed along a downhole completion comprising sand control equipment so as to enable isolation of well zones from which a production fluid, e.g. oil and/or gas, is received and produced to a desired collection location. Once positioned downhole, the packer or packers may be actuated by expanding the expandable metal bladder to drive the sealing element into sealing engagement with the surrounding borehole wall. The expandable metal bladder may be expanded and plastically deformed via application of sufficient pressure along its interior. For example, the expandable metal bladder may be expanded via hydroforming by directing fluid under pressure down through an interior of the well string and to an interior of the expandable metal bladder.

Figure 1:
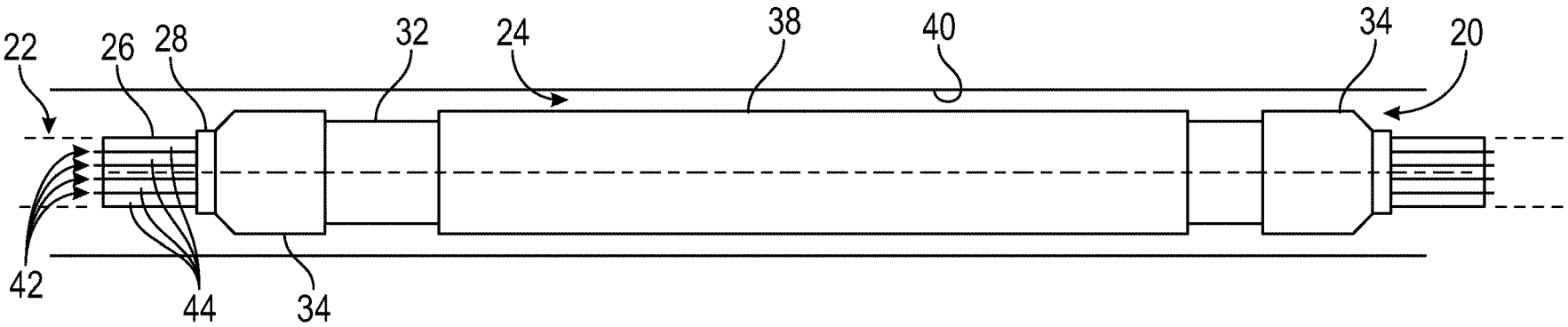
FIG. 1 is an illustration of an example of a packer utilizing an expandable metal bladder and at least one feedthrough, according to an embodiment of the disclosure.
Figure 2:
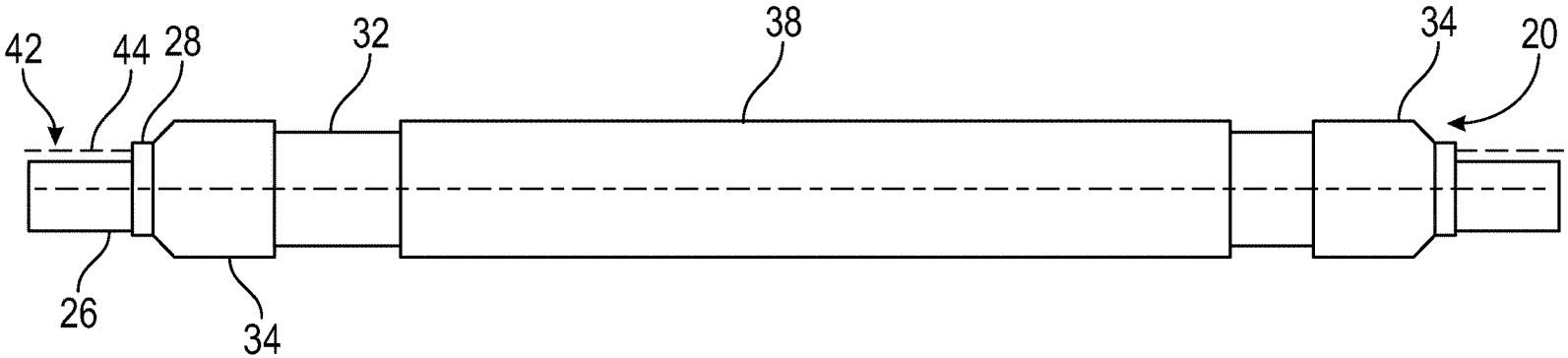
FIG. 2 is another illustration of the packer shown in FIG. 1, according to an embodiment of the disclosure.

Referring generally to FIGS. 1 and 2, an example of a packer 20 is illustrated as positioned along a well string 22 within a borehole 24, e.g. a wellbore. In this example, the packer 20 comprises an internal tubing 26 which may form part of the overall production tubing through which well fluid is produced to a desired collection location. The illustrated packer 20 further comprises a packer mandrel 28 mounted about the internal tubing 26 and having at least one longitudinal passage 30 serving as a feedthrough (see also FIGS. 3 and 4). By way of example, the packer mandrel 28 may comprise a plurality, e.g. three, four, five or more, passages/feedthroughs 30.

Figure 3:
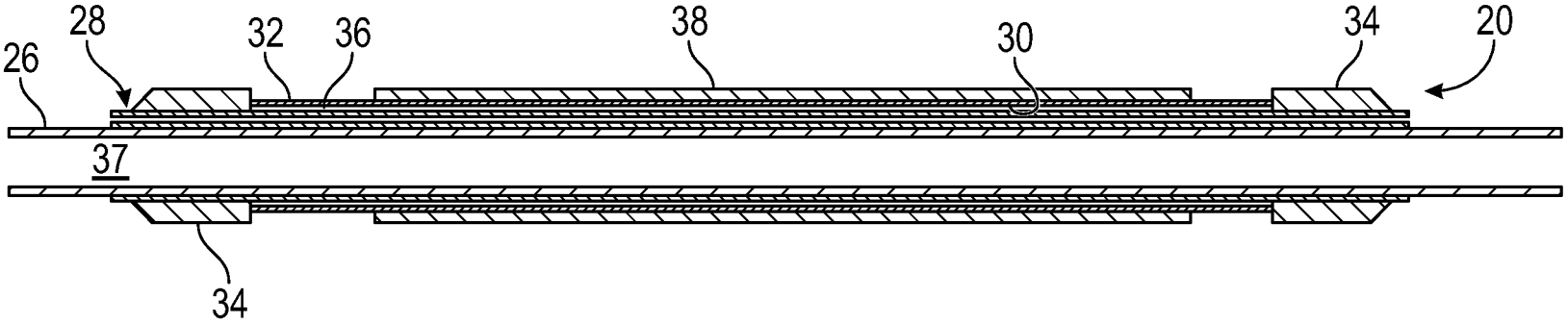
FIG. 3 is a cross-sectional illustration of the packer shown in FIG. 1, according to an embodiment of the disclosure.
Figure 4:
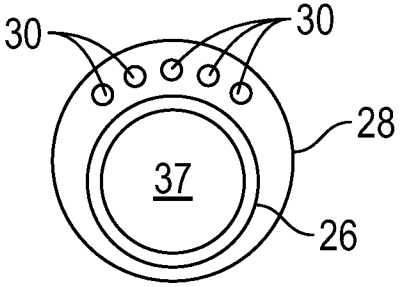
FIG. 4 is an end of view of an example of a mandrel utilized in the packer illustrated in FIG. 1, according to an embodiment of the disclosure.

As illustrated, the packer 30 also comprises an expandable metal bladder 32 which is secured around the packer mandrel 28 via suitable connections 34. The connections 34 may be in the form of end connections, as illustrated. The connections 34 may be sealingly secured to the expandable metal bladder 32 and the packer mandrel 28 via welding, crimping, using seals and locking mechanisms, or via other suitable connection techniques. The sealed engagement effectively forms an internal cavity 36 between the expandable metal bladder 32 and the packer mandrel 28, as illustrated in FIG. 3. The expandable metal bladder 32 may be selectively expanded via pressurized fluid delivered down through an internal passage 37 of the well string 22/internal tubing 26 and directed to internal cavity 36 via a suitable lateral port or ports as described below.

A sealing element 38, e.g. an elastomeric sealing element, may be adhered or otherwise secured about the expandable metal bladder 32. The sealing element 38 is positioned to move into sealing engagement with a surrounding borehole wall 40 defining borehole 24. When the expandable metal bladder 32 is sufficiently expanded via application of suitable internal pressure, the expandable metal bladder 32 is caused to expand and plastically deform so as to secure the sealing element 38 against borehole wall 40.

As illustrated in FIGS. 1 and 2, desired components 42 may be fed longitudinally through the passages 30 so as to provide desired functionality through the packer 20. For example, the components 42 may be in the form of bypass lines 44, e.g. alternate path tubes, hydraulic lines, and/or electric lines to ensure the desired function through packer 20.

Figure 5:
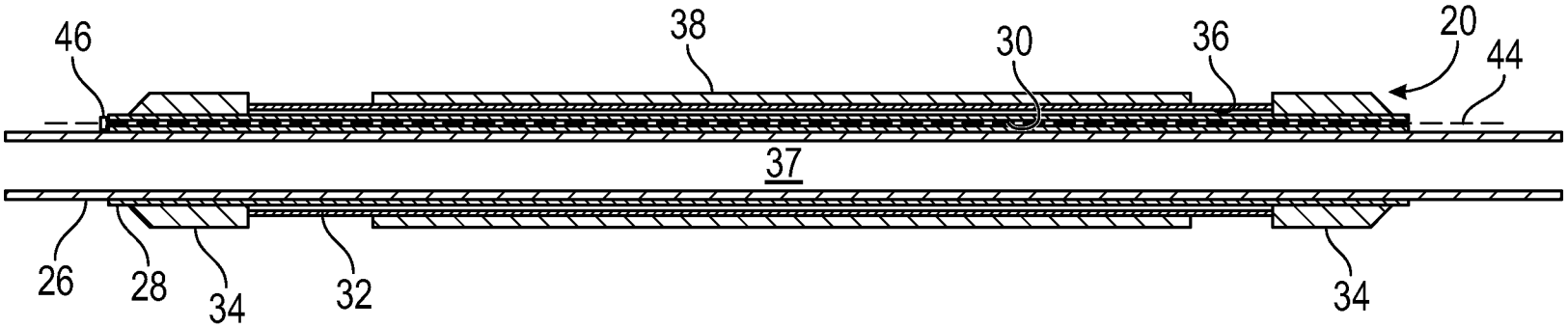
FIG. 5 is a cross-sectional illustration of an example of a packer having a plurality of feedthroughs for use with electric and/or hydraulic lines, according to an embodiment of the disclosure.

Referring generally to FIG. 5, an embodiment of packer 20 is illustrated in which the illustrated bypass line 44 is in the form of an electric line or hydraulic line. The bypass line 44 is routed through the feedthrough/passage 30 and sealed with respect to the feedthrough/passage 30. For example, a sealing connector 46 may be positioned around the bypass line 44 and inserted into an end of the feedthrough/passage 30 so as to form a seal between the bypass line 44 and the wall forming passage 30. Sealing connectors 46 may be elastomeric inserts or other suitable inserts used at one or both ends of the passage 30.

Figure 6:
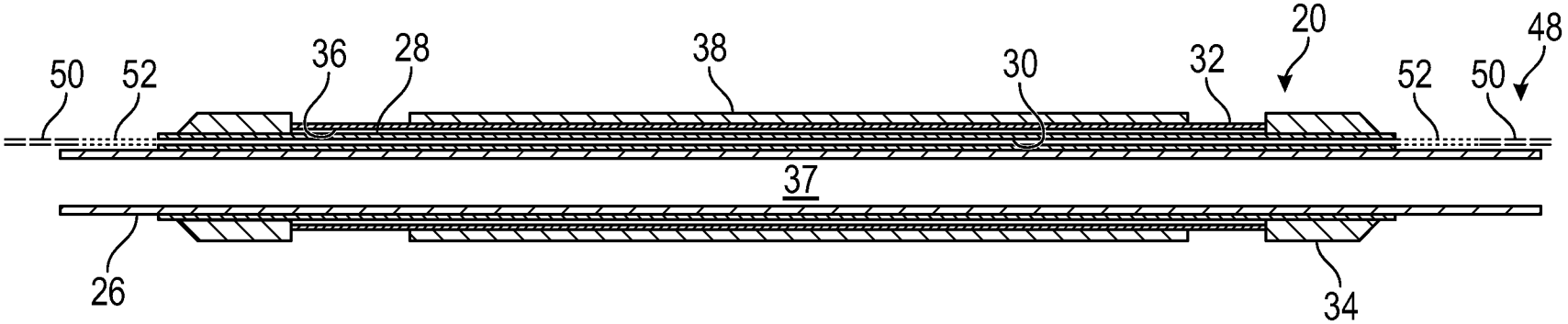
FIG. 6 is a cross-sectional illustration of an example of a packer having a plurality of feedthroughs for use with shunt tubes, according to an embodiment of the disclosure.
Figure 7:
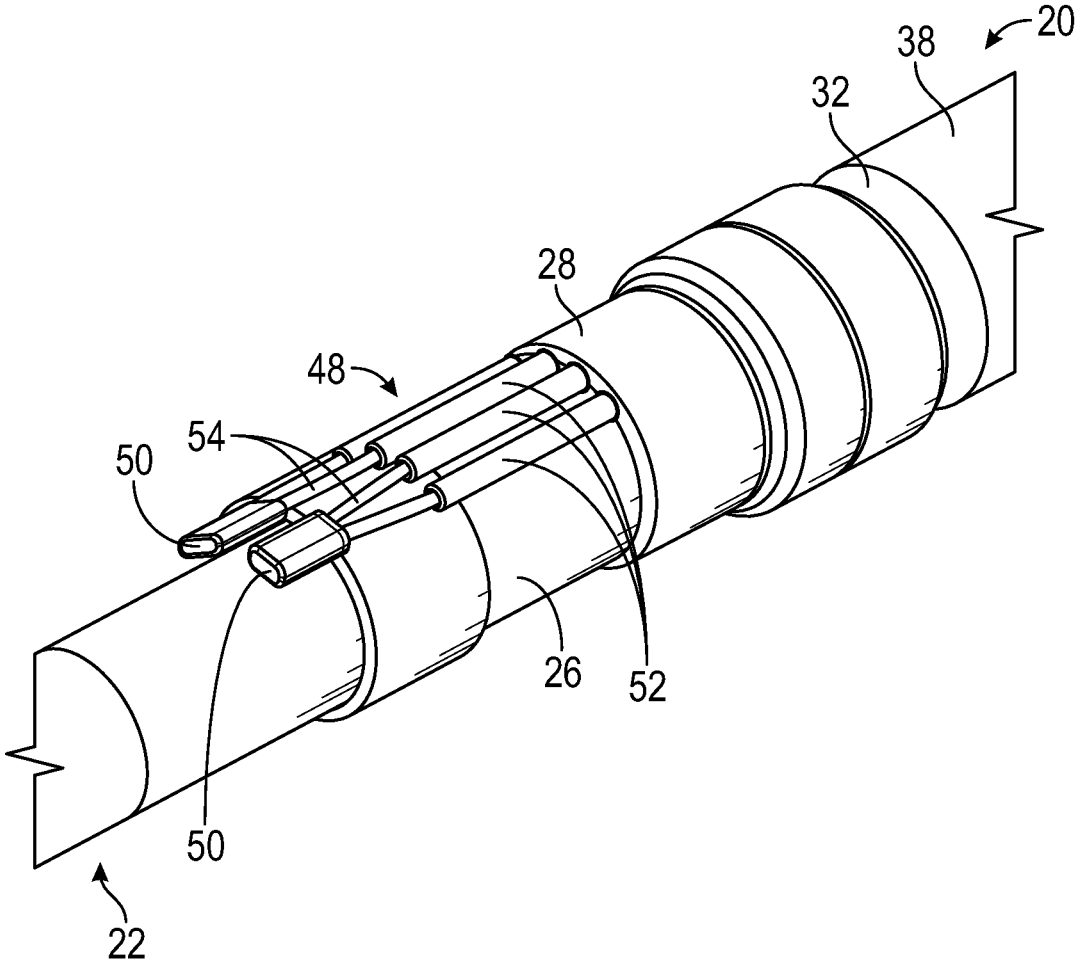
FIG. 7 is an orthogonal view of a portion of the packer illustrated in FIG. 6, according to an embodiment of the disclosure.

In FIG. 6, another embodiment of packer 20 is illustrated. In this example, an alternate path system 48 is deployed along the well string 22 and comprises shunt tubes 50 for carrying gravel slurry used in gravel packing operations. As illustrated, the respective shunt tubes 50 are connected at the ends of each passage 30 via corresponding connector tubes 52. Thus, the passages 30 are able to effectively create a tubing for conducting the flow of gravel slurry through the corresponding packer 20. In some applications, a shunt tube 50 can be sized for insertion through the corresponding passage 30. According to an embodiment, flow from individual shunt tubes 50 may be delivered to two or more connector tubes 52 and thus to two or more passages 30 via a flow splitter 54, as illustrated in FIG. 7. The use of such flow splitters 54 also facilitates connection of tubing having different cross-sectional shapes, e.g. connection of rectangular shunt tubes 50 with circular connector tubes 52. Other types of connection tubes also may be used for connecting dissimilar tubing shapes.

Figure 8:
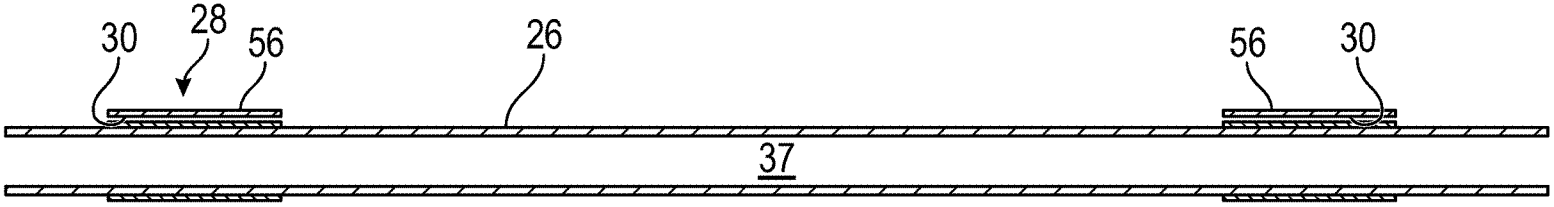
FIG. 8 is a cross-sectional illustration of another example of a mandrel which may be employed in a packer, according to an embodiment of the disclosure.
Figure 9:
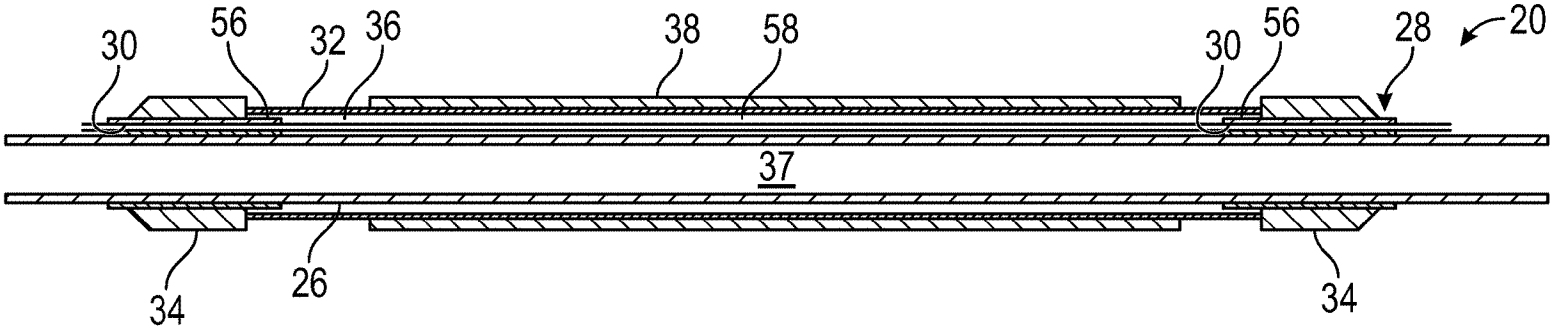
FIG. 9 is a cross-sectional illustration of another example of a packer having a plurality of feedthroughs, according to an embodiment of the disclosure.
Figure 10:
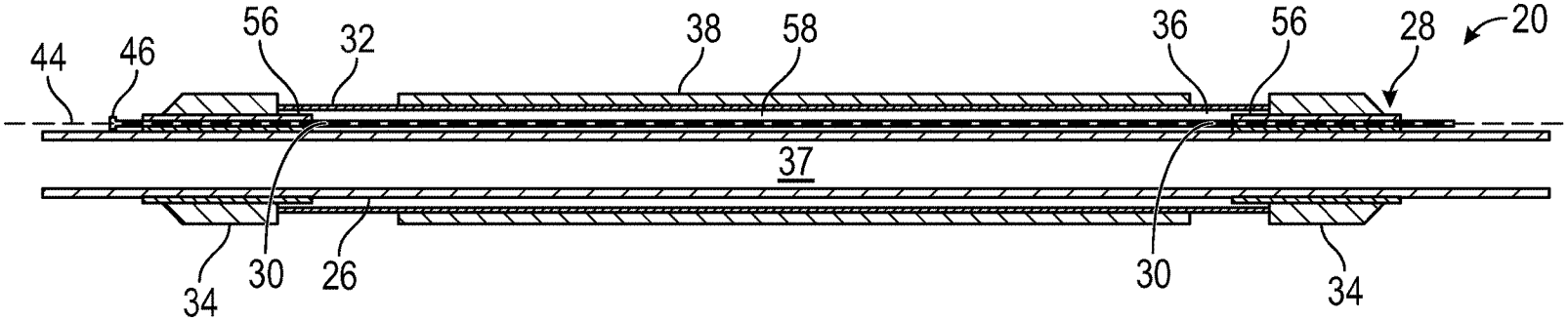
FIG. 10 is a cross-sectional illustration similar to that of FIG. 9 but showing electric and/or hydraulic lines extending through the plurality of feedthroughs, according to an embodiment of the disclosure.

Referring generally to FIGS. 8-10, another embodiment of packer 20 is illustrated. In this example, the packer mandrel 28 comprises a plurality of mandrel sections 56, e.g. two mandrel sections 56, which are separated longitudinally along the internal tubing 26. Each mandrel section 56 comprises a portion of the passage(s) 30 with open spacing therebetween. As a result, each passage 30 is shortened which can simplify passage formation techniques, e.g. passage drilling.

In some embodiments, a tubing 58 may be inserted through the aligned portions of a given passage 30, as illustrated in FIG. 9. This ensures an enclosed pathway through the entire packer 20. Effectively, the tubing 58 provides a sheath which may be utilized as a shunt tube for delivering gravel slurry or other materials through the packer 20. Additionally, the tubing 58 may provide an enclosed pathway for bypass lines 44, e.g. electric lines or hydraulic lines, as illustrated in FIG. 10. Each bypass line 44 may be connected/sealed to the tubing 58 via one or more sealing connectors 46.

Figure 11:
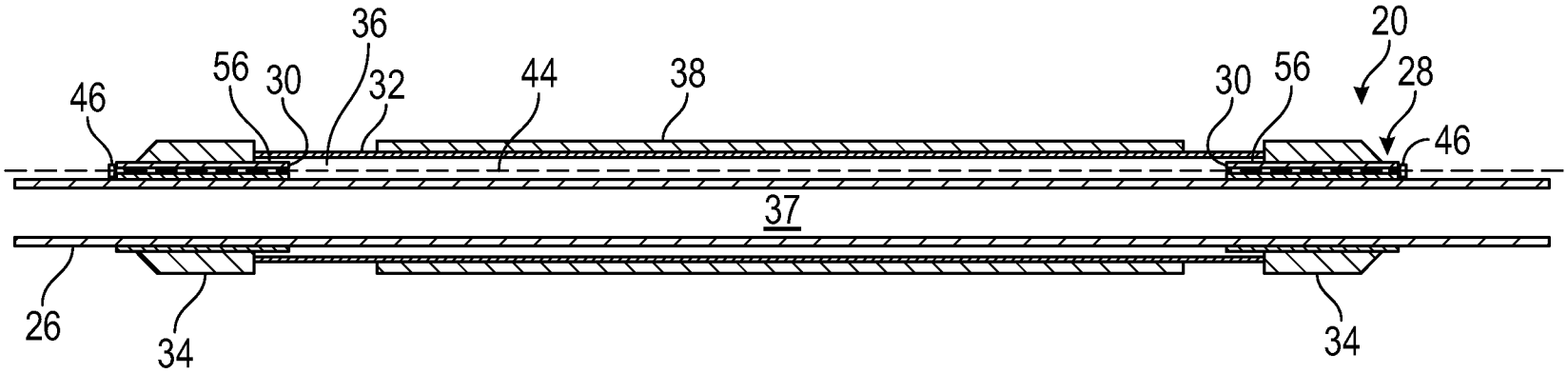
FIG. 11 is a cross-sectional illustration of another example of a packer having a plurality of feedthroughs, according to an embodiment of the disclosure.

In some embodiments, the tubing 58 may be omitted, and the bypass line 44 may be routed through the separated portions of passage 30, as illustrated in FIG. 11. For example, an electric/hydraulic line 44 can be pre-installed through the portions of passage 30 without tubing 58 and then sealed with respect to the portions of passage 30 via sealing connectors 46. In the example illustrated, two sealing connectors 46 are utilized on opposite ends of the passage 30.

Figure 12:
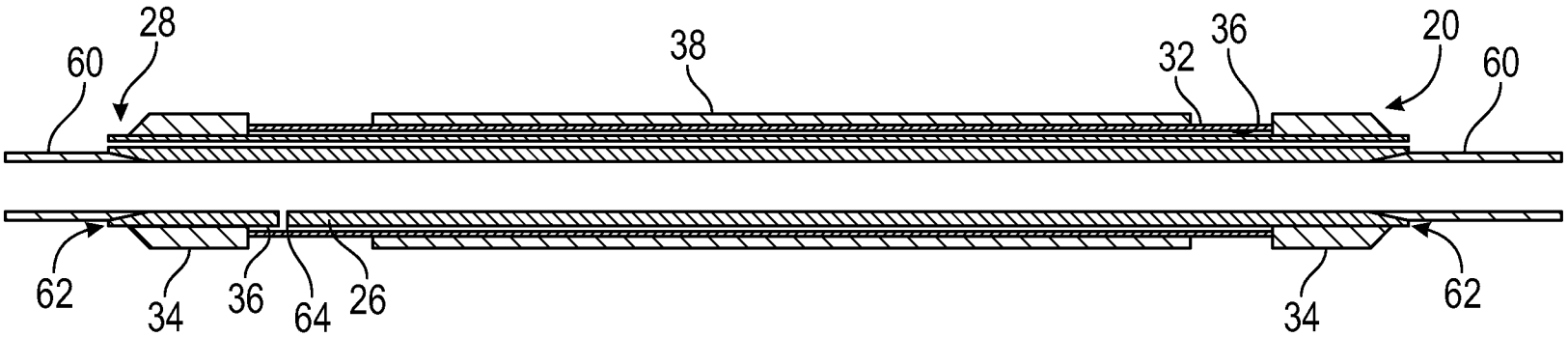
FIG. 12 is a cross-sectional illustration of another example of a packer having a plurality of feedthroughs, according to an embodiment of the disclosure.

Referring generally to FIG. 12, an example of packer 20 is illustrated in which the well string 22 comprises tubing joints 60, e.g. pup joints, which are engaged with internal tubing 26 of packer 20 via threaded connections 62 to form the desired production tubing. According to some embodiments, the threaded connections 62 may be timed connections. In the example illustrated in FIG. 12, the packer mandrel 28 is integrally formed with the internal tubing 26. However, the packer mandrel 28 may be a separate component connected to internal tubing 26.

Figure 13:
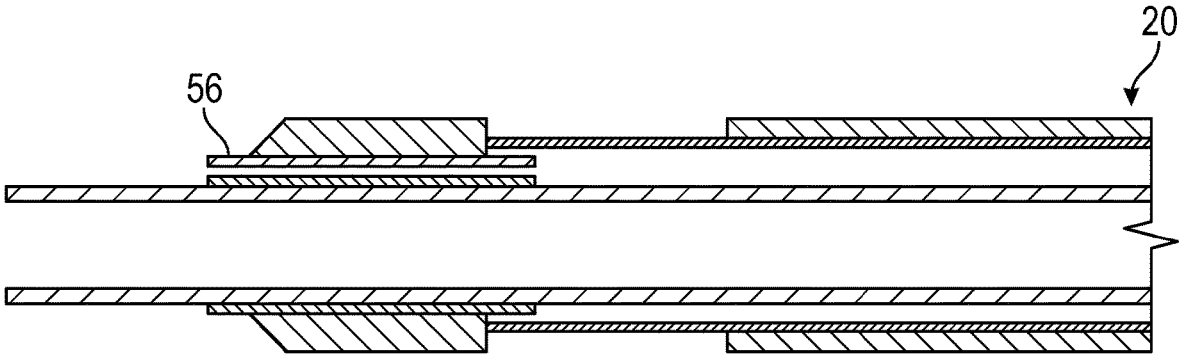
FIG. 13 is a cross-sectional illustration of another example of a packer with the mandrel element machined in one-piece, according to an embodiment of the disclosure.
Figure 14:
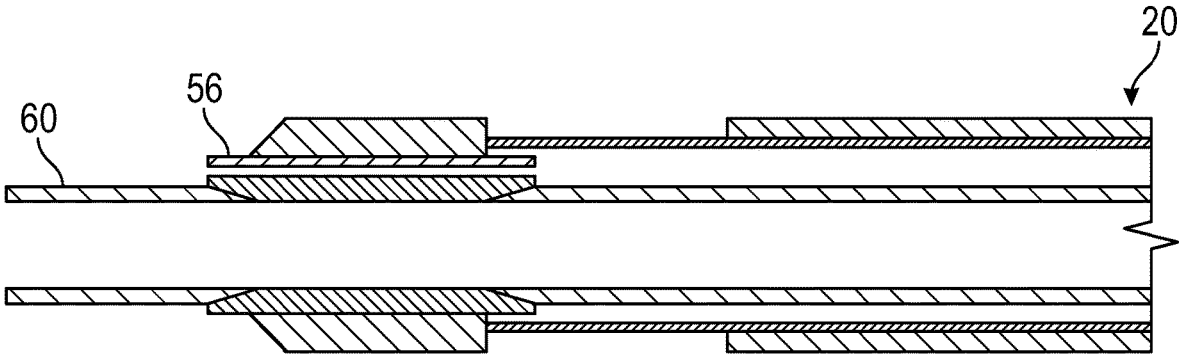
FIG. 14 is a cross-sectional illustration of another example of a packer with the mandrel element machined in one-piece, according to an embodiment of the disclosure.

Referring generally to FIG. 13 and FIG. 14, examples of packers 20 are illustrated in which the entire mandrel or at least the mandrel element 56 located at the packer ends level is machine in one-piece. Central part or tubing joints 60, e.g. pup joints, can be connected on each side of the mandrel element 56 and can be eccentric.

In any of the embodiments described herein, a lateral expansion port 64 (or ports 64) is provided through the wall forming internal tubing 26. The port(s) 64 enable flow of pressurized fluid from internal passage 37 to the internal cavity 36 between expandable metal bladder 32 and packer mandrel 28. The pressurized fluid may be used to expand and plastically deform the expandable metal bladder 32 so as to drive the sealing element 38 into sealing engagement with the surrounding wellbore wall 40.

Depending on the parameters of a given operation and the environment in which such operation is conducted, the components of packer 20 may be made from a variety of materials and in a variety of configurations. For example, the internal tubing 26 and mandrel 28 may be made as a unitary component or as separate components which are connected together. The packer mandrel 28 may be constructed as a single component or as a plurality of components with various numbers of passages 30 extending therethrough. The packer mandrel 28 also may be formed with different or varying diameter to facilitate assembly of components onto the packer mandrel 28. Similarly, the expandable metal bladder 32 and sealing element 38 may be constructed from a variety of materials and in a variety of sizes and configurations. Different types of connection techniques also may be utilized for connecting the packer components.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a packer sized for placement along a well string to enable formation of a seal at a desired location in a borehole, the packer comprising:

an internal tubing;

a packer mandrel located about the internal tubing and having at least one feedthrough extending longitudinally therethrough from a first axial end of the packer mandrel to a second axial end of the packer mandrel;

a first end connector disposed about the packer mandrel at the first axial end of the packer mandrel;

a second end connector disposed about the packer mandrel at the second axial end of the packer mandrel;

an expandable metal bladder secured around the packer mandrel and coupled to the first end connector and the second end connector; and a sealing element mounted around the expandable metal bladder and positioned to move into sealing engagement with a surrounding borehole wall when the expandable metal bladder is sufficiently expanded via internal pressure.

2. The system as recited in claim 1, wherein the at least one feedthrough comprises a plurality of feedthroughs.

3. The system as recited in claim 1, wherein the internal tubing comprises a laterally oriented expansion port through which the internal pressure is directed to the expandable metal bladder from an interior of the internal tubing.

4. The system as recited in claim 1, further comprising a component disposed longitudinally through the packer via the at least one feedthrough.

5. The system as recited in claim 4, wherein the component comprises tubing of an alternate path system.

6. The system as recited in claim 4, wherein the component comprises a hydraulic line.

7. The system as recited in claim 4, wherein the component comprises an electric line.

* * * * *